United States Patent [19]

Keenan et al.

[11] Patent Number: 4,566,400

[45] Date of Patent: Jan. 28, 1986

[54] HANDBELL

[75] Inventors: Charles E. Keenan, Perkasie; Richard E. Mattern, Souderton; Charles A. Vaccaro, Ambler, all of Pa.

[73] Assignee: Schulmerich Carillons, Inc., Sellersville, Pa.

[21] Appl. No.: 518,627

[22] Filed: Jul. 29, 1983

[51] Int. Cl.[4] ..... G10K 1/071; G10K 1/10; G10K 1/36

[52] U.S. Cl. ..... 116/171; 403/225; 403/372; 84/406; 116/163; 116/155; 116/149

[58] Field of Search ..... 116/148–150, 116/169, 170, 171; 84/406; 403/225, 227, 372; 464/75, 89

[56] References Cited

U.S. PATENT DOCUMENTS

| | | | |
|---|---|---|---|
| 116,241 | 6/1871 | Volger | 116/171 |
| 479,636 | 7/1892 | Droop | 446/422 |
| 1,490,914 | 4/1924 | Cornell | 446/422 |
| 3,139,855 | 7/1964 | Kunz | 116/171 |
| 3,207,124 | 9/1965 | Malta | 116/171 |
| 3,253,574 | 5/1966 | Malta | 116/171 |
| 3,941,082 | 3/1976 | Malta | 116/171 |

FOREIGN PATENT DOCUMENTS

| | | | |
|---|---|---|---|
| 220572 | 2/1908 | Fed. Rep. of Germany | 116/150 |

*Primary Examiner*—Charles Frankfort
*Assistant Examiner*—W. Morris Worth
*Attorney, Agent, or Firm*—Woodcock Washburn Kurtz Mackiewicz & Norris

[57] ABSTRACT

An improved bell is disclosed which features a clapper continuously adjustable for hardness of strike. The clapper comprises a hard inner member and a resilient outer member. The periphery of the clapper is circular but the hard inner member is not circular about the same center as the periphery so that the amount of resilient material between the solid inner core member and the periphery varies circumferentially around the clapper. At the time of manufacture of the bell it is tested to locate the point on the bell body at which "wow and flutter" in the tone emitted by the bell is minimized. A single insulated pin serves to orient the handle of the bell, the bell body and the plane of swing of the clapper. The attachment of the handle, the bell body and the clapper is such as to minimize extraneous noise. An elastomer clapper shaft is employed, and its effective flexing length may be varied.

8 Claims, 8 Drawing Figures

HANDBELL

FIELD OF THE INVENTION

This invention relates to handbells. More particularly, this invention relates to an improved handbell in which correct orientation of the handle and the plane of swing of the clapper is maintained relative to the point on the body of the bell which when struck produces the tone having the least amount of wow and flutter, while permitting relative variation of the alignment of a non-uniform clapper, which provides adjustment of the hardness of strike.

BACKGROUND OF THE INVENTION

The science of manufacturing bells dates back many centuries. Some of the problems faced by modern bell makers are precisely the same as those faced in medieval times. For example, it has been long known that there are two optimal points, spaced 180° apart around the bell body, at which any given bell should be struck. These are generally the points at which the frequency of the tone generated by the bell is the most uniform, i.e., has the least frequency variation, typically referred to as "wow and flutter." In order that a handbell can always be struck on one of these optimum points, it is necessary that the clapper be provided with some means for orientation so that the clapper always swings in the same plane. In the case of handbells it is known that it is desirable to provide an asymmetrical handle and means for orienting the handle with respect to the clapper so that the player may simply pick up a handbell and by the feel of its handle in his hand know the plane in which to swing the bell in order to cause the clapper to strike at the optimum point.

Prior clappers have generally been mounted on rigid clapper shafts pivoted on fixed axes in order to define the plane of swing. The pivot constructions used have been susceptible to wear, causing objectionable noise. In the present invention, the clapper shaft is instead a strip of flexible elastomeric material. Its strip-like cross-section means that it flexes more readily in one direction than the other, so as to define the plane of swing, while avoidance of metallic pivoting members prevents wear from causing noise.

It is also desirable that any handbell be provided with means controlling the swing of the clapper so that the player can readily prevent it from striking the wall of the bell more than once per stroke. Where a resilient clapper spring is used, this requires that means be provided to vary the compliance of the clapper shaft with respect to its direction of travel.

The prior art has provided bell designs featuring clappers which are adjustable to provide a strike of varying hardness for a given strength of swing. It is known, for example, that the tone resulting from a hard strike has greater numbers of audible overtones in proportion to the fundamental frequency, whereas a soft strike has less audible overtones. Accordingly, it would be desirable to provide a handbell having means for ready adjustment of the hardness of strike without interfering with the objectives discussed above, i.e., maintenance of the proper orientation of the handle with respect to the bell's body. While the prior art teaches variability of the hardness of the strike, the means taught therein are crude and not suited to ready variation, especially not during a performance. Moreover, while the art teaches ways in which the orientation of the clapper's plane of swing can be maintained while allowing adjustment of the hardness of strike between several widely differing possibilities, adjustment of the hardness of strike would desirably be made infinite, i.e., not be limited to a few choices, and means would be provided to enable the selection of a particular tone quality desired at any given time to be made simply, without elaborate tools and in a short time.

SUMMARY OF THE INVENTION

The present invention satisfies the needs of the art and objects of the invention listed above. It provides a novel handbell construction in which a single sound-insulative pin keys the handle to the head of the bell when assembled so that their relative orientation is preserved. The same pin continues on to index the clapper spring mounting structure so as to index all three major components of the bell together at once. Upon assembly of the bell at its place of manufacture, a worker locates the point at which it is desired that the clapper should contact the bell and drills the indexing hole in the bell head at that time. Thereafter no further adjustment need be made. Adjustment of the relative hardness of strike is made possible by provision of a clapper having peripheral resilient material of varying thickness over a hard clapper core, and means for maintaining the relative orientation of the clapper and the rest of the bell assembly so that the softness or hardness of the strike desired can be changed by the player. The conventional metal clapper shaft and shaft pivot are eliminated in favor of a clapper shaft comprising a length of oriented elastomer material rigidly attached to the bell yoke at one end and attached to the clapper at the outer end. When the bell is swung, the shaft flexes, so that the clapper moves with respect to the bell body. Use of the elastomeric clapper shaft eliminates the extraneous vibrations of mechanical pivots. The length and cross-section of the elastomer shaft are selected to produce the proper strike point and flexural characteristics for each bell size. Means are provided for adjusting the relative length of the clapper shaft so as to allow variance of the effective flex length of the shaft, thus modifying its stiffness characteristics, while ensuring that the bell is still always struck at the preferred point.

BRIEF DESCRIPTION OF THE DRAWINGS

The invention will be better understood if reference is made to the accompanying drawings, in which.

DESCRIPTION OF THE PREFERRED EMBODIMENTS

Figure 1:
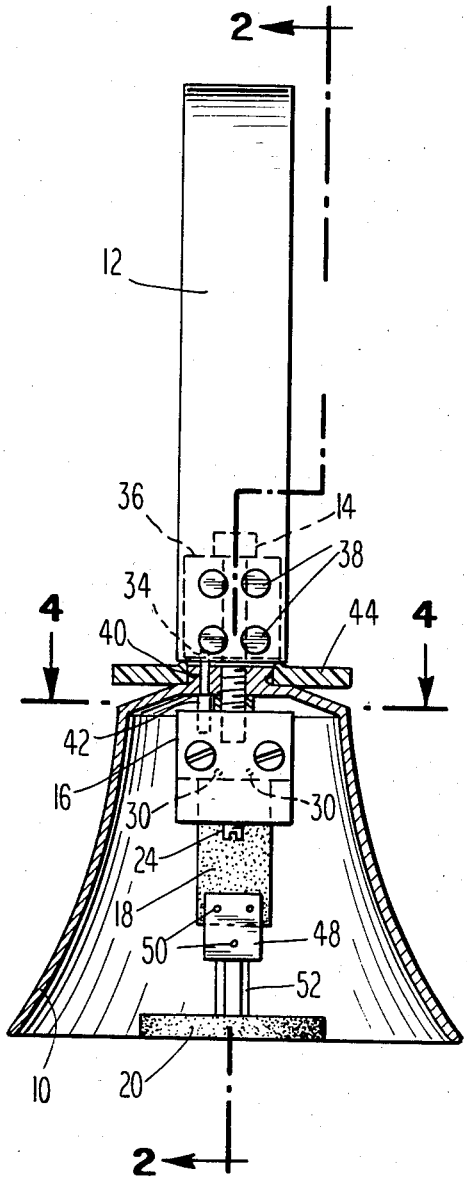
FIG. 1 represents a cross-sectional view of the bell of the invention.
Figure 2:
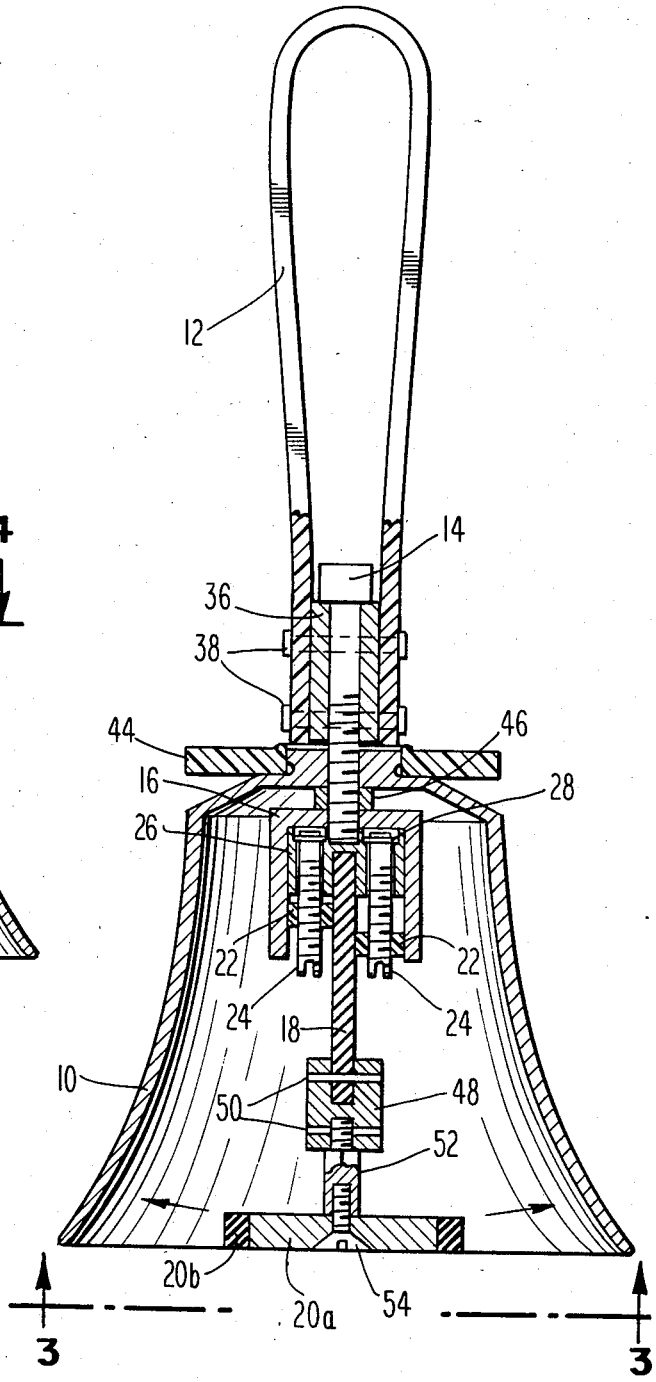
FIG. 2 shows a cross-sectional view taken along the line 2—2 of FIG. 1.
Figure 2A:
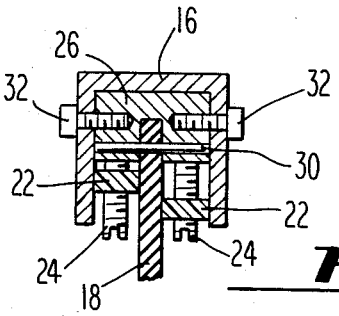
FIG. 2A shows a cross-sectional view taken along a line parallel to the line 2—2.

FIGS. 1, 2 and 2A will be discussed together. FIGS. 1 and 2 relate to orthogonal cross-sectional views of the bell of the invention. FIG. 2A is a sectional view taken parallel to line 2—2 but displaced slightly therefrom. The body of the bell 10 is substantially conventional. It may be cast of a bell bronze, typically 81% copper, 19% tin, and turned to shape after casting. A handle 12 is attached to the bell body 10 by means of a threaded screw 14 which passes through the head of the bell body 10 into a shaft yoke 16. To the shaft yoke. 16 is assembled the clapper shaft 18 from which the clapper 20 depends. As shown, the shaft 18 is substantially rectangular in cross-section, and may be formed of a flat strip of material. The flat strip shape of the shaft 18 makes its bending very highly oriented so that it tends to swing only in the plane perpendicular to its thinnest dimension, i.e., left to right in the view of FIG. 2, thus defining a plane of swing. By aligning the handle 12, the bell body 10 and the shaft 18 permanently, the clapper 20 can thus be constrained to strike the bell body 10 at the opposing points, where the least wow and flutter is noted.

Adjustment of the relative length of the clapper shaft 18, and control of its swing so that it swings more freely in one direction than the other, are provided by a pair of shaft adjustment blocks 22 which as shown in FIGS. 2 and 2A ride up and down with respect to the clapper shaft on a pair of set screws 24 which are secured in recesses in a shaft retainer 26 by e.g., C-clips 28. In the embodiment shown, shaft retainer 26 holds the shaft 18 by means of roll pins 30 (FIG. 2A) which extend therethrough. The shaft and shaft retainer assembly is then assembled within the yoke 16 and secured by means of screws 32 (FIG. 2A); the roll pins 30 thus are confined by the yoke 16 and cannot work loose. As shown, the shaft blocks 22 may be at different heights with respect to the shaft 18. This ensures that the shaft will swing more freely to one side than another and in turn that the clapper 20 can easily be controlled to strike the wall of the bell 10 only once per swing which is highly desirable when playing music using handbells. The height of the block 22 (on the right) in conjunction with the characteristics of the elastomer shaft 18 produces a snubbing action which restrains the clapper allowing it to strike only the opposite side of the bell. On the other hand, if desired for fast repetitive playing such as trilling, the blocks 22 may be adjusted to be of equal height. This will allow the clapper 20 to strike the bell body 10 at opposing points.

As discussed above, it is necessary that the orientation of the handle 12, the bell body 10 and clapper 20 be maintained at all times. This is done in the preferred embodiment by means of a single pin 34 which extends from a handle block 36 to which the handle 12 may be fastened by means Of rivets 38 or the like) through a hole 40, and into the yoke 16. Typically, the handle block 36 and the shaft yoke 16 will have the respective holes for pin 34 drilled at the time of manufacture. When the bell body 10 is manufactured it may be test assembled and struck at a plurality of locations, for example, every 20 degrees around its circumference. The optimal point of striking may be located by ear, with a frequency display instrument or with a spectrum analyzer, e.g., displaying its output on a cathode-ray tube. A workman locating this point listens and looks for steady display of the tonal frequency of the bell, as the wow and flutter which are to be minimized are essentially variations in the frequency of the tone produced by the bell. When the point has been located the indexing hole 40 can be drilled through the head of the bell to ensure proper assembly of the locating pin 34. Enlarged views of the connection between handle block 36, bell 10 and shaft yoke 16 are discussed below in connection with FIGS. 4 and 5.

Figure 5:
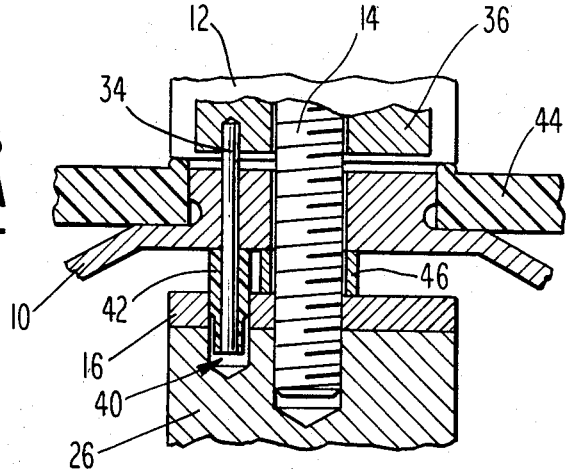
FIG. 5 shows an enlarged cross-sectional view of the joint between the bell body and handle taken along line 5—5 of FIG. 4.

It is desirable that the shaft yoke 16 be isolated from pin 34 in order to prevent extraneous vibrations or "buzz" from being generated by chance contact at these points and conducted through the pin 34. To this end, a plastic sleeve 42 may be placed over the pin 34 to prevent any vibration from reaching the bell. A handguard disc 44 may also be provided, to prevent the users' hand slipping onto the bell and for decorative and pitch identification purposes. It is retained in place by the ends of the handle 12 which also holds it tight to the bell body, again so as to prevent extraneous vibrations. As shown in FIG. 5, direct contact of the metallic handle block 36 and bell 10 is thus avoided. A spacer 46 may also be interposed between the shaft yoke 16 and the body of the bell 10 to prevent undesirable vibrations being generated at the two surfaces. The spacer material may be either sound conducting or sound dampening to enhance the overall sound from a particular size bell.

Figure 3:
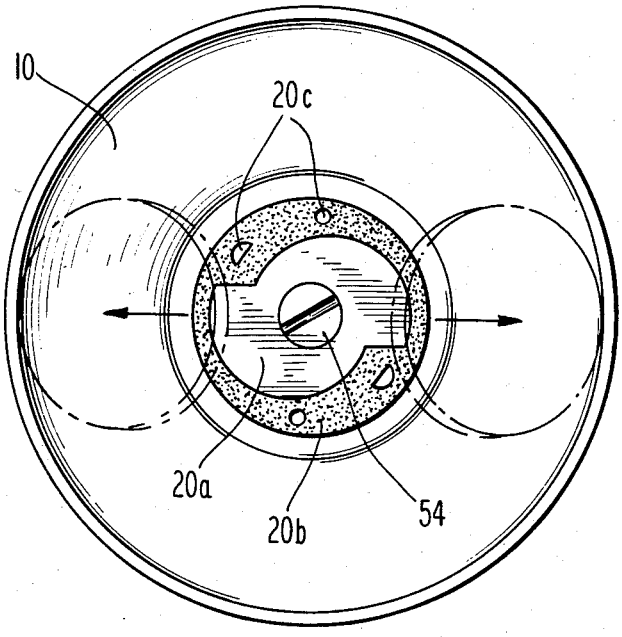
FIG. 3 shows a bottom view of the bell along the line 3—3 of FIG. 2.

The clapper shaft 18 may comprise a polyurethane or other elastomer material having a hardness selected to provide the desired flex and snubbing characteristics. It is assembled to the clapper 20 by means of a coupling 48 which may be formed of brass. The clapper shaft 18 is attached to the coupling 48 by means of roll pins (or other means) passing therethrough. The clapper 20 is held to the coupling by a screw 54; an intermediary brass connecting shaft piece 52 (which may also be an integral part of coupling 48) may be used, as shown. As shown in FIGS. 2 and 3, the clapper comprises a core member 20*a*, which may be formed of a brass material, and a resilient peripheral member 20*b* formed of resilient plastic material such as polyethylene molded around the brass core. The plastic material and its Durometer value will vary to suit the generation of tones and partials (e.g., overtones) desired and will also depend on the bell size.

The shape of the clapper member 20 is shown best in FIG. 3. It is desirable that the outer periphery of the clapper be substantially circular as shown. The brass core 20*a*, however, is formed in a double half moon or spirally varying shape, as shown. Loosening of the screw 54 then permits the player to rotate the clapper 20 with respect to the clapper shaft 18, and hence vary the point on the clapper 20 which will contact the body of the bell 10. This allows relatively more or less of the resilient material 20*b* to be interposed between the hard brass core 20*a* and the bell body 10 when the strike is effected. As noted, this permits variation in the hardness of the strike which, in turn, alters the quality of the overtones present in the tone output by the bell. This feature is very desirable when fine tuning a bell to the tastes of the player. The smoothly varying shape of the periphery of the core 20*a* permits this adjustment to be made on an infinitely fine basis, unlike any of the clapper adjustment schemes shown by the prior art. The shape of the clapper shown permits quite a useful variation in the tonal quality of the bell. The resilient part 20*b* of the clapper 20 may also be provided with one or more voids 20c as shown which further serve to modify its hardness characteristics.

Figure 4:
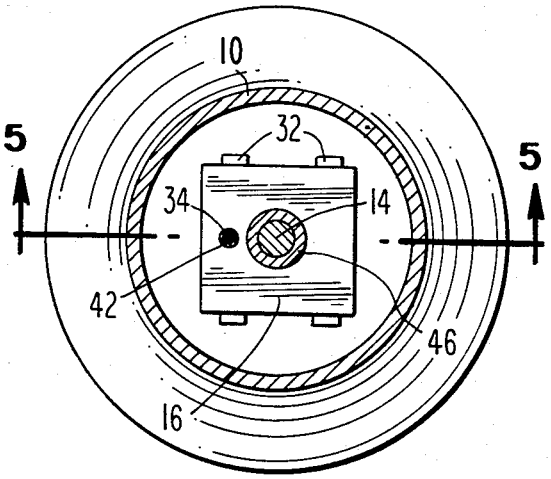
FIG. 4 shows a cross-section through the neck of the bell where the bell body is joined to the handle along line 4—4 of FIG. 1.

FIGS. 4 and 5 show enlarged views and certain additional details of the area in which the bell 10 is connected to the shaft yoke 16 and to the handle 12. As seen in FIG. 5, the screw 14 passes downwardly through the spacer 46, through the handle block 36 (which is riveted to the handle) through the head of the bell 10 and is threaded into the shaft yoke 16. The relative orientations of the handle, the bell and the shaft are maintained by the indexing pin 34 which, as noted, is insulated by a plastic sleeve 42. As shown in FIG. 5, the screw 14 may additionally attach the shaft retainer 26, but in a preferred embodiment this is instead held to the shaft yoke 16 by screws, as shown in FIG. 2A.

Those skilled in the art will recognize that the selection of the material for the resilient portion of the clapper 20 involves careful consideration of numerous factors including but not limited to the size and pitch of the bell being manufactured, the relative amount of overtones and partials to be produced with respect to the fundamental frequency of the bell, and its overall tonal characteristics. The specific shape of the resilient and hard portions of the clapper will vary as will the hardness of the resilient portion and the shape of the void sections 20c if any are used. Further possibilities include, in the case of larger bells, filling such voids with materials such as felt, again in order to vary the tonal characteristics of the clapper. For example, a relatively small bell may have the resilient portion of its clapper formed of a material such as Delrin or the like, with a Durometer hardness value of roughly 100. When larger bells are manufactured, an impact "thud" must be suppressed. This can be accomplished by changing the Durometer hardness to a lower value and using holes such as 20c in the resilient portion of the clapper 20; the sizes and shapes of such voids 20c would differ with varying sizes of bells. Slots may also be used, in particular in connection with the larger size of bells so as to accept strips of felt, again to minimize the impact thud.

The specific clapper design shown is intended for use with a bell having the conventionally understood tonal designation $F_5$; a resilient material of Durometer value approximately 90 gives pleasing tonal qualities.

Figure 6:
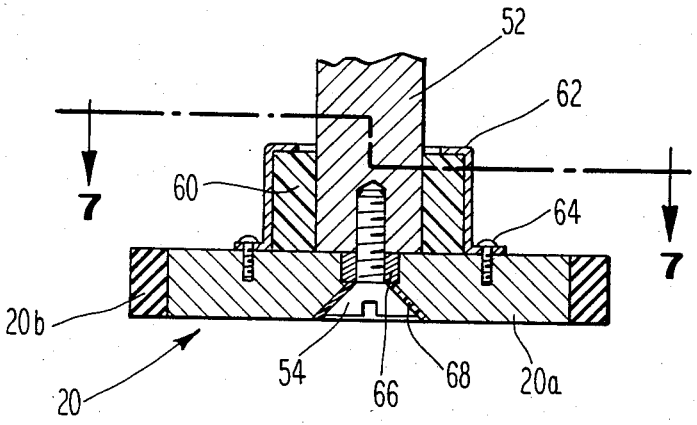
FIG. 6 shows an alternative method of mounting the clapper to the clapper shaft.
Figure 7:
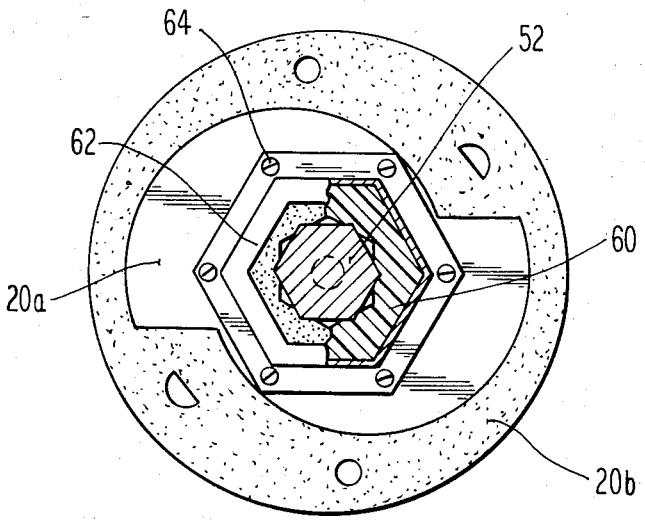
FIG. 7 is a cross-section taken along the line 7—7 of FIG. 6.

FIGS. 6 and 7 show an alternative method of mounting the clapper to the clapper shaft. It will be appreciated that in the embodiment discussed above, a screw 54 holds the clapper with respect to the member 52. However, in order to adjust the relative orientation of the clapper with respect to the bell it is necessary to loosen screw 54 and then retighten it with the clapper having been rotated to the desired position. This is not always convenient. The arrangement in FIGS. 6 and 7 provides a simple way in which the clapper may be rotated without use of tools. FIG. 6 corresponds generally to the view of FIG. 2, while that of FIG. 7 is a cross-section taken along the line 7—7 of FIG. 6. The clapper 20 is affixed to the member 52 by means of a screw 54. A spacer 66 allows rotation of the clapper without rotation of the screw 54; a washer 68 of an antifriction material such as "Teflon" may also be interposed. Orientation of the clapper 20 is maintained by the hex-shaped support member 52 fitting relatively closely within a correspondingly-shaped orifice in an elastomeric bushing 60 which, in turn is contained within a hex-shaped retainer 62. The retainer 62 is then fastened to the solid core 20a of the clapper 20, for example by screws 64; solder, adhesive or other means could also be used. The fact that the bushing 60 is of a resilient material, such as polyurethane, permits the clapper to be rotated with respect to the member 52. The "corners" of the hex-shaped shaft 52 compress the elastomer bushing 60 slighlty until the rotation has proceeded to a degree that the hex is again aligned with the hex-shaped orifice molded into the bushing 60. Other interfitting shapes are possible; for example, as shown in FIG. 7, the orifice in the bushing 60 may comprise two hexagons overlaid with respect to one another by 30° so as to define additional orientations to the clapper 20. Of course, it will be appreciated that other polygonal shapes could be used. In the embodiment just described, applying a torque to the clapper causes the assembly of the clapper, the hex retainer 62 and the hex-shaped bushing 60 to rotate with respect to the hex shaft 52. It would also be possible to arrange it so that application of torque would cause the retainer 62 to rotate with respect to the bushing 60; the bushing 60 being fixed with respect to the hex shaft. This is a matter of controlling the relative shapes and sizes of the parts involved. For example, if a twelve-sided resilient bushing 60 were used in conjunction with a hex-shaped retainer 62, the retainer/clapper assembly would turn with respect to the bushing/hex-shaft assembly.

It will be appreciated that the arrangement just described permits a finite number of adjustments of the relative position of the clapper with respect to its plane of swing to be made. More adjustments are provided by this arrangement than are shown in any of the prior art patents mentioned above, but perhaps more importantly, the clapper's inner core structure 20a has a continuously varying outer contour so that the selection of the relative position is between one of a plurality of gradually varying positions, not between a smaller number of greatly differing clapper hardnesses, as shown in the prior art.

Those skilled in the art will recognize that there has been described a handbell having means for permitting adjustment of the relative hardness of the strike by relative rotation of a clapper having a resilient surface, while maintaining the relative orientation of the handle, plane of swing of the clapper and preferred location of strike. The attachment of the handle, bell, clapper and clapper shaft is such as to minimize extraneous vibrations and to damp any which may occur. The clapper design shown is symmetrical with respect to the plane of swinging of the clapper spring. This is preferred so that in the event a double strike, i.e., on diametrically opposite positions on the bell body, is desired, the two strikes are relatively similar in loudness. However, it should be appreciated that the clapper design need not be symmetrical but instead might comprise, for example, a spiral or circular core portion disposed off-center within a circular resilient outer portion. In such a clapper, the hardest point would be diametrically opposite the softest point.

Heretofore, the invention has been described solely in the context of a handbell in which a clapper is disposed within the center of the bell. There have recently been developed a new class of bells, sometimes referred to as "hand chimes" which generally comprise metallic tubes having slots formed in two opposite sides of the tube extending longitudinally from one end thereof part way along the length of the tube, so as to form a hollow tuning fork or resonant tube structure. Typically these handchimes are fitted with clapper mechanisms which are mounted outside of the tube. For example, one manufacturer uses a U-shaped metal clapper having a felt material over its surface in the region of contact, which is carried by a rubber pivot-suspension to hold the clapper away from the tube. When the handchime is swung, the rubber suspension flexes, and the U-shaped clapper strikes the tube causing it to ring. The flexed rubber suspension then brings the U-shaped clapper back away from the tube. The principal of the strike is the same as that of the handbell but the strike can occur in only one direction. It would be desirable in such hand chimes to provide means for adjustment of the hardness of strike for the same reasons discussed above with respect to handbells, i.e., variation of the tonal quality of the bell. Accordingly, it will be appreciated by those skilled in the art that the clapper and clapper shaft construction shown by the present invention could readily be adapted to hand chime construction simply by devising a clapper shaft suspension outside the tubular hand chime. Accordingly, use of the term "bell" in the claims which follow should be understood to include musical instruments other than the internal clapper bells shown in the drawings, such as hand chimes, where the context does not indicate otherwise.

Other modifications and variations on the embodiment of the invention discussed above will no doubt occur to those skilled in the art. Accordingly, the above description should be taken as exemplary only and the invention should be considered to be defined only by the following claims.

I claim:

1. A bell comprising a bell body for emitting a musical tone when struck and having a preferred point for striking on its body; and a clapper affixed to said bell body by means constraining said clapper to swing in a plane fixed with respect to said preferred point such that said clapper strikes said bell at said preferred point, the orientation of said clapper being controllably variable for adjustment of the tonal quality produced by said bell upon being struck by said clapper, said clapper having a substantially circular periphery and comprising (1) a first relatively hard central portion having at least a partially circular outline and (2) a second relatively resilient outer portion having a substantially circular periphery, the center of said partially circular outline of said hard central portion being off-center with respect said substantially circular periphery of said clapper whereby the radial extent of said resilient portion between said hard central portion and the clapper periphery varies circumferentially around said clapper thereby permitting said adjustment in tonal quality as said clapper orientation is varied.

2. A handbell comprising (1) a bell body member (2) a clapper suspension comprising an elongated resilient shaft member which flexes more easily in a first plane than in the plane perpendicular thereto; and (3) a clapper having a substantially circular periphery and comprising an inner member of a hard material and an outer member of a resilient material for contacting said bell body member, the radial extent of said resilient material between said inner member and the periphery of said clapper varying substantially continuously around said clapper;

wherein said clapper suspension defines a fixed perferred plane of swing of said clapper substantially identical to said first plane of easy flex; wherein said clapper is rotatably adjustable such that different points on the periphery of said clapper may be selected to contact said bell body member, whereby the hardness of the contact between said clapper and said bell body member and tonal quality produced by said contact may be varied with respect to a given physical force exerted on the handbell, said rotatable adjustability being provided by affixing said clapper to said shaft member by a polygonal core member fitting into a corresponding-shaped orifice in a resilient bushing member carried in a bushing retainer so that upon application of a torque to said clapper, the bushing member is compressed permitting relative movement of the bushing member with respect to the shaft member, whereby variation between a number of predetermined relative positions of said clapper and the plane of swing of said shaft member is provided.

3. A musical instrument comprising a body for emitting a musical tone when struck, and a clapper for striking said body wherein:

said clapper is mounted on a resilient clapper shaft comprising a single elongated strip of a flexible material, said strip having substantially greater extent in one direction in the plane perpendicular to its axis of elongation than in the direction orthogonal thereto, such that said strip flexes in a preferred plane, said shaft being fixed to said body at one end and to said clapper at the other end, whereby upon swinging of the musical instrument the resilient clapper shaft flexes in said preferred plane so that the clapper impacts the body at a predetermined location;

said clapper is affixed to said clapper shaft by a polygonal core member fitting into a corresponding-shaped orifice in a resilient bushing member carried in a bushing retainer, so that upon application of a torque to said clapper, the bushing member is compressed permitting relative rotation of the clapper with respect to the shaft between a number of predetermined relative positions; and said clapper comprises a resilient outer portion for striking said body and a solid inner portion, said outer portion providing a separation between the solid inner portion and said body when said clapper and said body are in contact, said separation being adjustable by said rotation of the clapper to vary the tonal qualities of the sound produced by the body upon being struck.

4. A handbell comprising (1) a bell body member;

(2) a clapper suspension comprising an elongated resilient shaft member which flexes more easily in a first plane than in the plane perpendicular thereto; and (3) a clapper having a substantially circular periphery and comprising an inner member of a hard material and an outer member of a resilient material for contacting said bell body member, the radial extent of said resilient material between said inner member and the periphery of said clapper varying substantially continuously around said clapper;

wherein said clapper suspension defines a fixed preferred plane of swing of said clapper substantially identical to said first plane of easy flex; wherein said clapper is rotatably adjustable such that different points on the periphery of said clapper may be selected to contact said bell body member, whereby the hardness of the contact between said clapper and said bell body member and tonal quality produced by said contact may be varied with respect to a given physical force exerted on the handbell; and wherein a metallic pin covered with a sound absorptive and sound insulative material extends through said bell body member and into means locating the plane of swing of said clapper suspension, whereby said pin serves to orient said bell body member and the plane of swing of said clapper.

5. The handbell of claim 4 further comprising a handle.

6. The handbell of claim 5 wherein said pin additionally serves to orient said handle with respect to said bell body member and the plane of swing of said clapper.

7. The handbell of claim 4 wherein the hole through said bell body member which receives said pin is located on said bell body member at the time of manufacture of said handbell.

8. A generally planar circular clapper for a musical instrument having a solid inner portion and a resilient outer portion, said solid inner portion having a peripheral shape such that the radial extent of said solid portion between the center of said clapper and its periphery varies substantially continuously around said clapper whereby the amount of resilient material between the inner portion of said clapper and its periphery varies substantially continuously around said clapper, and wherein said peripheral shape of said solid inner portion substantially comprises a pair of semi-circles, the centers of said semi-circles being spaced away from one another along a radius of said clapper, to form a double half moon confgiguration.

* * * * *